US006832059B2

(12) United States Patent
Fujiwara

(10) Patent No.: US 6,832,059 B2
(45) Date of Patent: Dec. 14, 2004

(54) IMAGE FORMING APPARATUS FEATURING DUAL POLARITY, MULTIPLE TIMING BIAS APPLYING MEANS

(75) Inventor: Motohiro Fujiwara, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 10/459,424

(22) Filed: Jun. 12, 2003

(65) Prior Publication Data

US 2003/0235420 A1 Dec. 25, 2003

(30) Foreign Application Priority Data

Jun. 21, 2002 (JP) ..... 2002-180676

(51) Int. Cl.[7] ..... G03G 15/16
(52) U.S. Cl. ..... 399/66
(58) Field of Search ..... 399/43, 45, 46, 399/66, 297, 298, 313, 314, 367, 368, 389, 400

(56) References Cited

U.S. PATENT DOCUMENTS 5,761,572 A 6/1998 Watanabe et al. ..... 399/66
6,181,890 B1 * 1/2001 Kataoka et al. ..... 399/67
6,697,583 B2 * 2/2004 Ishii ..... 399/66
6,721,515 B2 * 4/2004 Kuribayashi et al. ..... 399/44
6,775,490 B2 * 8/2004 Eck et al. ..... 399/66

FOREIGN PATENT DOCUMENTS

JP 9-152793 6/1997
JP 2000-72705 3/2000

* cited by examiner

*Primary Examiner*—Hoang Ngo
(74) *Attorney, Agent, or Firm*—Fitzpatrick, Cella, Harper & Scinto

(57) ABSTRACT

An image formation apparatus includes: an image formation unit for forming toner images on a photosensitive drum; a transfer belt for transporting sheets of a transfer medium; an electrostatic transfer unit transferring toner images on the photosensitive drum onto the sheets; a cleaning unit for cleaning residual matter including toner form the photosensitive drum; a charger for applying a bias of a polarity which is inverse to a normal polarity of the toner, to the transfer unit; and a control unit for controlling operations of the charger. The control unit controls the charger such that a transfer bias is applied in sheet spacing between consecutive sheets, so that there is no flow of current to edge portions at the leading and trailing edges of the sheets, that sheet spacing transfer off time is one photosensitive drum cycle or less, that the transfer bias current is set to zero within leading and trailing sheet margins, and that the image is transferred onto the transfer medium in an image region.

19 Claims, 7 Drawing Sheets

FIG. 4

| | d1 | d2 | e1 | e2 | INCOMPLETE TRANSFER AT LEADING EDGE | STREAK ON PHOTOSENSITIVE MEMBER ONE ROTATION FOLLOWING LEADING/TRAILING EDGE | CHATTERING EVERSION OF CLEANING BLADE | OVERALL |
|---|---|---|---|---|---|---|---|---|
| EMBODIMENT | 0.10 | 0.01 | 0.25 | 0.01 | NONE | NONE | NONE | SATISFACTORY |
| COMPARATIVE EXAMPLE 1 | 0.00 | 0.01 | 0.25 | 0.01 | NONE | OBSERVED | NONE | UNSATISFACTORY |
| COMPARATIVE EXAMPLE 2 | 1.00 | 0.01 | 0.25 | 0.01 | NONE | NONE | OBSERVED | UNSATISFACTORY |
| COMPARATIVE EXAMPLE 3 | 0.10 | 0.00 | 0.25 | 0.01 | NONE | OBSERVED | NONE | UNSATISFACTORY |
| COMPARATIVE EXAMPLE 4 | 0.10 | 0.02 | 0.25 | 0.01 | OBSERVED | NONE | NONE | UNSATISFACTORY |
| COMPARATIVE EXAMPLE 5 | 0.10 | 0.01 | 0.00 | 0.01 | NONE | OBSERVED | NONE | UNSATISFACTORY |
| COMPARATIVE EXAMPLE 6 | 0.10 | 0.01 | 1.00 | 0.01 | NONE | NONE | OBSERVED | UNSATISFACTORY |
| COMPARATIVE EXAMPLE 7 | 0.10 | 0.01 | 0.25 | 0.00 | NONE | OBSERVED | NONE | UNSATISFACTORY |
| COMPARATIVE EXAMPLE 8 | 0.10 | 0.01 | 0.25 | 0.02 | OBSERVED | NONE | NONE | UNSATISFACTORY |

IMAGE FORMING APPARATUS FEATURING DUAL POLARITY, MULTIPLE TIMING BIAS APPLYING MEANS

BACKGROUND OF THE INVENTION

1. Field of the Invention

The present invention relates to an image formation apparatus which forms images by transferring a toner image formed on an image carrying member onto a transfer medium.

2. Description of the Related Art

Hitherto, there have been proposed image formation apparatuses such as electrostatic photocopiers and printers and the like which form images based on image information converted into digital signals, and some arrangements of such image formation apparatuses comprise an image carrying member upon which an electrostatic latent image is formed, a developing device for developing the electrostatic image formed on the image carrying member using a developing agent so as to form a developing agent image, and a transfer device for transferring the developing agent image formed on the image carrying member onto a transfer medium.

FIG. 7 is a schematic diagram illustrating the interior configuration of such a conventional image formation apparatus, wherein reference numeral 101 denotes a photosensitive drum, which comprises a photosensitive member formed of amorphous silicon or the like on the surface thereof, and which serves as an image-carrying member for forming an electrostatic latent image, 102 denotes a primary charger for charging the surface of the photosensitive drum 101, 104 denotes a developing device which applies voltage between a developing sleeve 104*a* and the photosensitive drum 101 to develop the electrostatic latent image with toner serving as a developing agent, thereby forming a toner image which is the developing agent image formed on the photosensitive drum 101, and 110 denotes a pre-transfer charger for making uniform a charge of the toner image formed on the photosensitive drum 101, 108 denotes a transfer belt for holding and transporting a transfer medium P in contact with the photosensitive drum 101, 113 denotes a transfer blade which applies a current from the back side of the transfer belt 108 so as to transfer the toner image formed on the photosensitive drum 101 onto the transfer medium P, 105 denotes a separating charge for separating the transfer medium P from the transfer belt 108, 111 denotes a cleaning device which removes toner residually adhering to the photosensitive drum 101 instead of being transferred onto the transfer medium P (untransferred residual toner), using a cleaning blade 111*a*, 106 denotes a fixing device for fixing the image formed on the transfer medium P thereupon, and 112 denotes a semiconductor layer for casting a laser beam 123 modulated by image signals, wherein the laser beam 123 cast from the semiconductor laser 112 is reflected by a rotating polygonal mirror 114 and then passes through an imaging lens 116 and reflected by a reflecting mirror 115, so as to perform raster scanning on the surface of the photosensitive drum 101.

With such an image formation apparatus configuration, a toner image is first formed applying the image-creating processes of charging, exposing, and developing on the photosensitive drum 101, followed by transferring of the toner image onto the transfer medium P, and subsequently fixing the toner image so as to obtain an article with an image formed thereupon.

The cleaning blade 111*a* cleans the surface of the photosensitive member by rubbing the surface thereof, and the residual toner and any external additives on the surface of the photosensitive drum 101 following the transfer processes play an important role in increasing the lubricity between the cleaning blade 111*a* and the photosensitive member, polishing the photosensitive member, and suitably grinding the photosensitive member.

The effects thereof are great in the event of using an external additive effective in increasing lubricity such as titanium oxide or alumina fine powder, or using an external additive effective in increasing polishability such as strontium titanate powder, ceric oxide powder, calcium titanate powder, and so forth, for example.

That is to say, these external additives are effective in increasing the lubricity on the surface of the photosensitive member, polishing the photosensitive member, and suitably grinding the photosensitive member. Also, these external additives serve to prevent deterioration of image quality due to substances generated by discharge of the chargers 102 and 110, or components in the toner, adhering to the surface of the photosensitive member, and to prevent deterioration of the slidability of the cleaning blade due to an increase in the friction coefficient on the surface of the photosensitive member.

However, some of these external additives have weak adhesion as to the toner, and some have a polarity which is inverse to a friction charging polarity of the toner, so in the event that the developing device 104 is operated at any time other than when forming an image, this results in the external additives scattering off of the toner on the developing agent holding member (developing sleeve), and even in the event that an electrical field is formed between the developing agent holding member and the photosensitive member so that the toner does not adhere to the photosensitive member, the external additives charged with the inverse polarity may depart from the toner and adhere to the photosensitive member. Accordingly, operating the developing device at times other than when forming images causes the amount of external additives within the developing agent to decrease.

In the event that the amount of external additives within the developing agent in the developing device decreases, the amount of external additives adhering to the photosensitive member along with the toner also decreases, so the amount of external additives sent to the cleaning device 111 as untransferred residue decreases.

In the event that the amount of external additives sent to the cleaning device 111 decreases thus, the lubricity with the surface of the photosensitive member decreases, and the effects of polishing and suitably grinding the photosensitive member decrease, leading to deterioration of image quality due to substances generated by a discharge from the chargers, or components in the toner, adhering to the surface of the photosensitive member.

Also, the friction coefficient on the surface of the photosensitive member rises due to the adhering substances, leading to poor slidability of the cleaning blade 111*a*, which further leads to chattering of the cleaning blade 111*a* or eversion thereof. Such problems occur particularly readily with photosensitive drums which are not readily ground, such as a-Si drums, since the substances adhering to the drums are not readily removed.

Such problems also occur in the event that the time in which the developing device operates during non-image-formation periods is long, for example, and the time of the developing device operating during non-image-formation periods becomes long in cases such as forming continuous images with a transfer medium having a great basis weight, such as heavy paper or the like.

The reasons for these problems are as follows: in the event of carrying out the fixing process consecutively on a transfer medium having a great basis weight, the fixing speed generally must be slowed since defective fixing readily occurs due to the temperature of the fixing device dropping, which in turn leads to more spacing between the transfer mediums (hereafter also referred to as "sheet spacing"). This slowdown is to prevent a subsequent transfer medium from colliding with a transfer medium undergoing fixing in the event that the fixing speed is slower but the image formation speed is not changed, which could lead to faulty transportation and improper images. Or, in the event that both the image formation speed and the fixing speed are made to be slower, the amount of time elapsed is longer even in the event that the sheet spacing is the same as before the change in speed. Due to such reasons, the sheet spacing time becomes greater, and consequently, the amount of time wherein the developing device is being operated in the non-image-formation period becomes longer. As a result, the cleaning capabilities decrease, which has been a problem.

Japanese Patent Laid-Open No. 9-152793 discloses an arrangement wherein transfer bias is applied to the margin of the leading side of the sheet following the leading edge thereof reaching the transfer position, and wherein the transfer bias is turned off at the margin on the trailing side before the trailing edge of the sheet reaches the transfer position, in order to prevent charging of the photosensitive drum due to transferring while preventing faulty transfer at the leading and trailing edge portions of the toner image.

Also, Japanese Patent Laid-Open No. 2000-72705 discloses an arrangement wherein bias with the same polarity as transferring is applied in the event that the transfer medium is not present in order to prevent the back side of the transfer medium from becoming soiled due to toner charged with an inverse polarity, thereby preventing inverse-polarity toner from migrating from the photosensitive drum side to the transfer member.

However, these documents neither disclose nor make any mention of the problem of unstable cleaning conditions due to a decrease in the external additives within the toner, much less either disclose or mention a method to deal with the problem.

SUMMARY OF THE INVENTION

The present invention has been made in light of the above-noted problems, and accordingly it is an object thereof to provide an image formation apparatus capable of effectively removing foreign matter on the image holding member without deterioration of image quality.

To this end, according to a first aspect of the present invention, an image formation apparatus comprises: image formation means for forming a toner image on an image carrying member; transporting means for transporting a transfer medium; transfer means for electrostatically transferring the toner image onto a transfer medium transported by the transporting means to a transfer unit; cleaning means for cleaning residual matter including toner from the surface of the image carrying member; bias applying means for applying a bias of a polarity which is inverse to a normal polarity of the toner, to the transfer means; and control means for controlling operations of the bias applying means; wherein, in the event of forming images on multiple transfer mediums in a continuous manner, the control means places the bias applying means in an inoperative state at a first timing before a trailing edge of a preceding transfer medium reaches the transfer unit, places the bias applying means in an operating state at a second timing following the trailing edge of the preceding transfer medium passing through the transfer unit, places the bias applying means in an inoperative state at a third timing before a leading edge of a subsequent transfer medium reaches the transfer unit, and places the bias applying means in an operating state at a fourth timing following the leading edge of the subsequent transfer medium passing through the transfer unit.

According to a second aspect of the present invention, an image formation apparatus comprises: image formation means for forming a toner image on an image carrying member; transporting means for transporting a transfer medium; transfer means for electrostatically transferring the toner image onto a transfer medium transported by the transporting means to a transfer unit; cleaning means for cleaning residual matter including toner from the surface of the image carrying member; bias applying means for applying a bias of a polarity which is inverse to a normal polarity of the toner, to the transfer means; bias application operations control means for controlling operations of the bias applying means; fixing means for fixing the toner image transferred to the transfer medium; and transfer medium spacing control means capable of changing the transfer medium spacing time from a trailing edge of a preceding transfer medium passing through the transfer unit until a leading edge of the subsequent transfer medium is transported to the transfer unit, in the event of forming images on multiple transfer mediums in a continuous manner, wherein the bias application operations control means enables operation of the bias applying means in the transfer medium spacing time according to the transfer medium spacing time.

Further objects, features, and advantages of the present invention will become apparent from the following description of the preferred embodiments (with reference to the attached drawings).

BRIEF DESCRIPTION OF THE DRAWINGS

FIG. 4 is a Table showing the results of image formation, and so forth, with the image formation apparatus.

DESCRIPTION OF THE PREFERRED EMBODIMENTS

The following is a detailed description of embodiments of the present invention, with reference to the drawings.

First Embodiment

Figure 1:
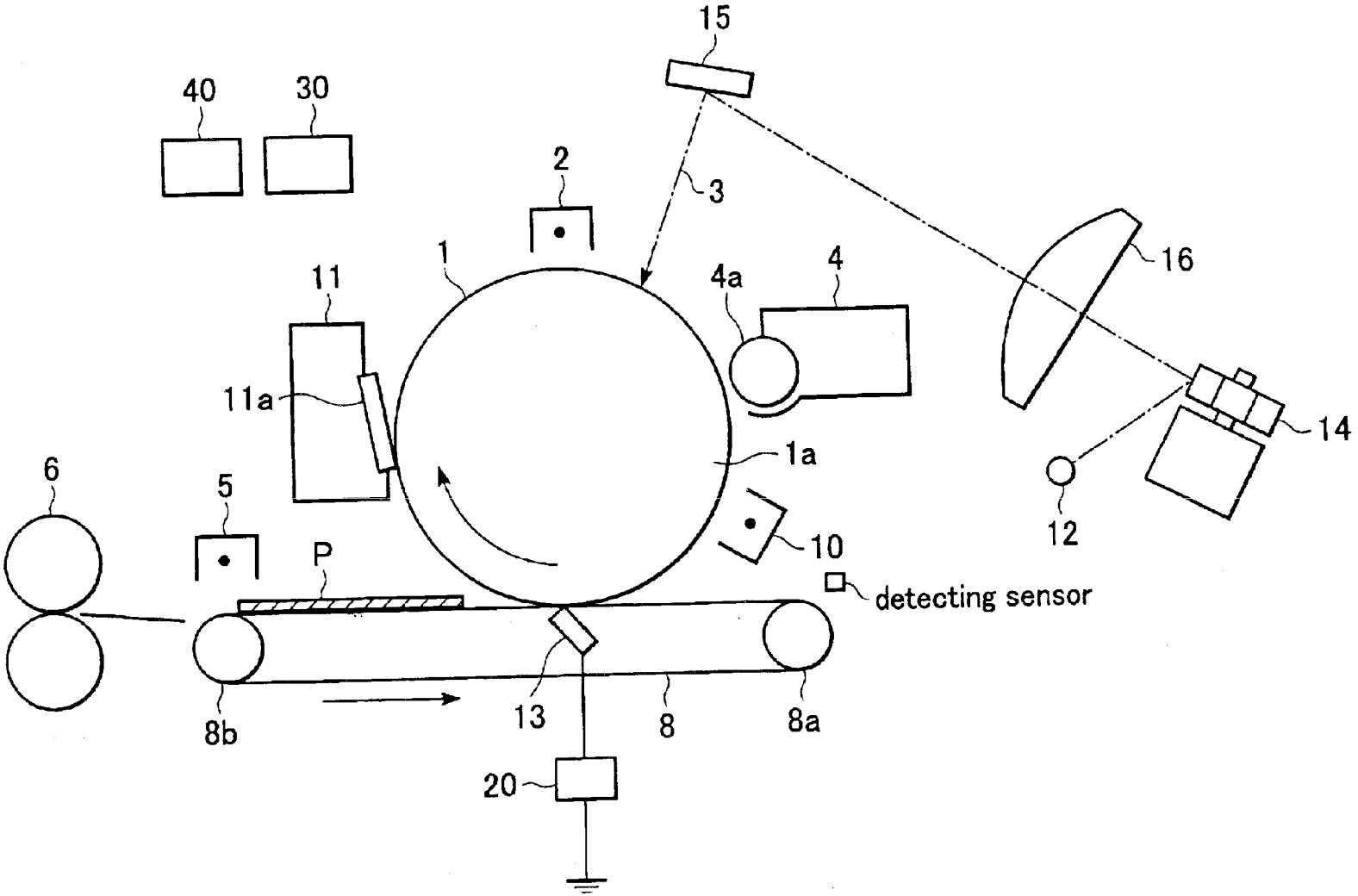
FIG. 1 is a schematic diagram of the internal configuration of an image formation apparatus according to an embodiment of the present invention.

FIG. 1 is a schematic diagram illustrating the interior configuration of an image formation apparatus according to an embodiment of the present invention, wherein reference numeral 1 denotes a photosensitive drum upon which an electrostatic latent image is formed, to serve as an image carrying member. The photosensitive drum 1 has a photosensitive member (layer) formed of amorphous silicon on the circumferential face of an electroconductive photosensitive drum supporting member 1*a* which is 60 mm in diameter and formed of aluminum or the like. The photosensitive drum 1 is rotationally driven at a process speed (circumferential speed) of 200 mm/sec in the direction indicated by the arrow in the drawing, i.e., in the clockwise direction, by a driving device (not shown).

Reference numeral 2 denotes a primary charger serving as corona charging means for charging the surface of the photosensitive drum. The primary charger 2 uniformly charging the surface of the photosensitive drum 1 to a predetermined potential of a negative charge, by a charging bias applied from a charging bias power source (not shown).

Reference numeral 4 denotes a developing device for developing the electrostatic latent image by applying a voltage between a developing sleeve 4*a* and the photosensitive drum 1, thus forming a toner age on the photosensitive drum 1. The developing device 4 causes toner to adhere to the electrostatic latent image formed on the photosensitive drum 1 by a developing bias applied from a developing bias power source (not shown), thus forming a negative image as a toner image, or visualizing the electrostatic latent image.

Note that with the present embodiment, a single-component, non-contact developing method is used. This developing method involves using a developing agent wherein toner particles have been magnetized, the developing agent is transported to a developing region by a magnetic force, and the developing agent is caused thereby to jump to the photosensitive drum 1, a process known as "jumping developing". Further, the developing agent used with the single-component non-contact developing method involves toner particles with an average grain diameter of 7.5 $\mu$m that have been formed of polyester resin as a toner, to which strontium titanate powder with an average grain diameter of 1 $\mu$m which charges to a polarity which is opposite to a polarity of the toner, and hydrophobic alumina fine powder with an average grain diameter of 0.1 $\mu$m, have been externally added. Note that the toner particles charge to a negative polarity.

Reference numeral 8 denotes a transfer belt adjacent to the photosensitive drum 1, for carrying and transporting the transfer medium P, the transfer belt 8 running over a driven (slave) roller 8*a* and a driving roller 8*b*. The transfer belt 8 moves (rotates) in the direction indicated by the arrow, synchronously with rotation of the photosensitive drum 1, by a rotational driving force of the driving roller 8*b*.

Reference numeral 13 is a transfer blade for applying electric current from the rear side of the transfer belt 8, so as to transfer the toner image formed on the photosensitive drum 1 onto the transfer medium P. The transfer blade 13 is formed of an elastic material, and comes into contact with the photosensitive drum 1 across the transfer belt 8, which is an endless transfer medium carrying member, at the transfer unit. This causes the transfer bias, with a polarity which is inverse to the polarity of the toner, and which is applied from the transfer bias power source 20, to transfer the toner image on the photosensitive drum 1 onto the transfer medium P which is a paper sheet or the like being transported by adhering onto the moving transfer belt 8 due to electrostatic absorption or the like, at the transfer unit between the photosensitive drum 1 and the transfer blade 13.

Reference numeral 5 denotes a separating charger for separating the transfer medium P from the transfer belt 8, 10 denotes a pre-transfer charger for making the charge of the toner image formed on the photosensitive drum 1 uniform, and 11 denotes a cleaning device for removing the toner residually adhering to the photosensitive drum 1 that was not transferred onto the transfer medium P, i.e., untransferred residue, by using a cleaning blade 11*a* formed of an elastic material which follows the photosensitive drum 1 in the longitudinal area and is in contact therewith in a direction which is counter to a rotation direction of the photosensitive drum 1.

A scoop sheet (not shown) is provided upstream from the cleaning blade 11*a* in respect to the rotating direction of the photosensitive drum 1, i.e., below the cleaning blade 11*a*. All of the residual toner on the surface of the photosensitive drum 1 which has been scraped off by the cleaning blade 11*a* is recovered in a cleaning container by the scoop sheet. 1.

Reference numeral 6 denotes a fixing device for fixing the images formed on the transfer medium P. Upon the transfer medium P being transported thereto, the fixing device 6 applies pressure and heat to the transfer medium P, thereby melting the unfixed toner image on the transfer medium P and fixing it, so that a image is fixed on the transfer medium P.

Reference numeral 12 is a semiconductor laser for irradiating a laser beam 3 modulated by image signals. A laser beam 3 cast from the semiconductor laser 12 is reflected by a rotating polygonal mirror 14, passes through an imaging lens 16 and reflected by a reflecting mirror 15, and performs raster scanning on the photosensitive drum 1.

With an image formation apparatus of such a configuration, a toner image is formed on the photosensitive drum 1 by the image formation processes of charging, exposing, and developing. Following formation of the toner image, the toner image is transferred onto the transfer medium P, following which the image is fixed, so as to obtain an article with an image formed thereupon.

Figure 2:
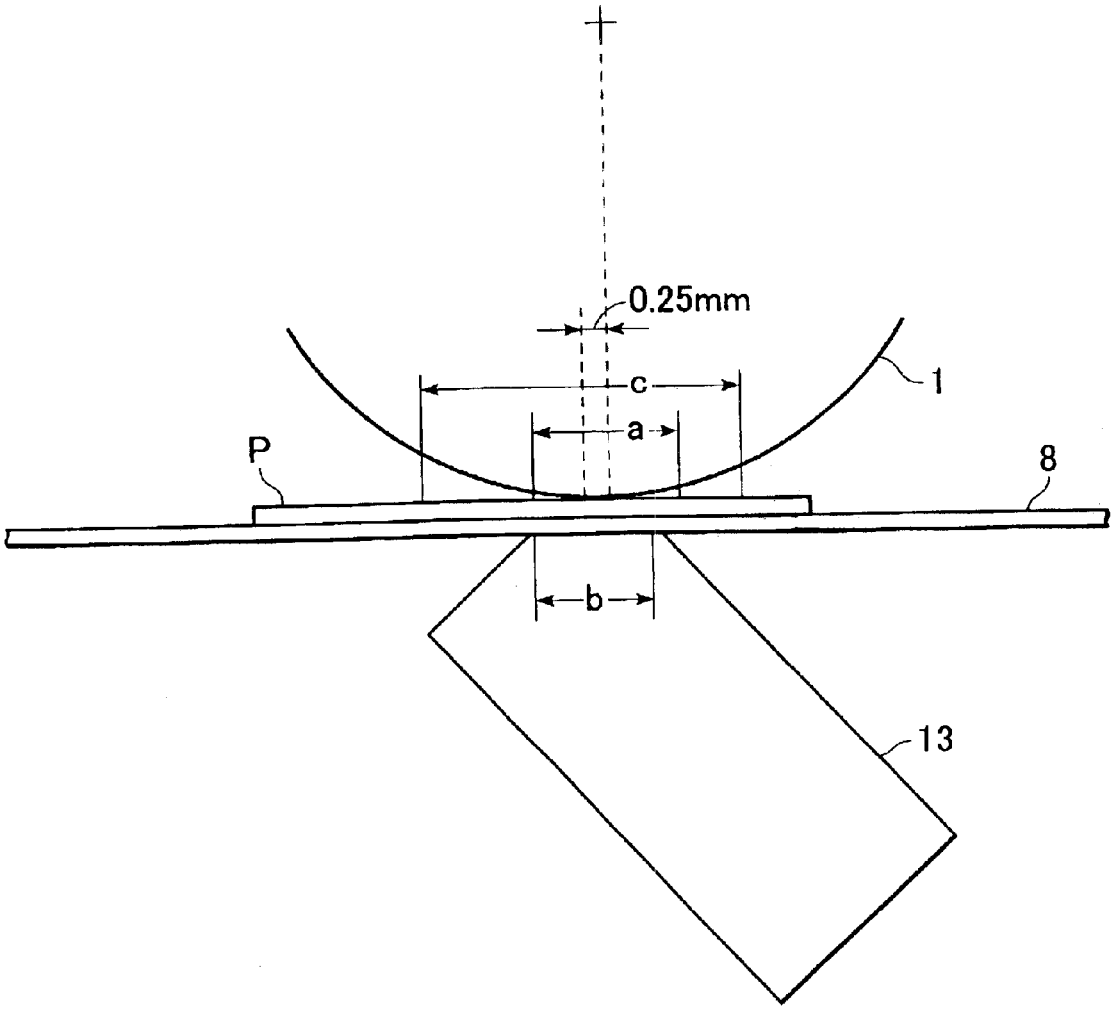
FIG. 2 is an enlarged diagram of the transfer unit of the image formation apparatus.

FIG. 2 is an enlarged image of the transfer unit, wherein reference character "a" represents a nipping width (contact width) between the transfer medium P and the photosensitive drum 1. With the present embodiment, the transfer medium P is in contact with the photosensitive drum 1 over a width of 0.25 mm. Reference character "b" represents the nipping width between the transfer blade 13 and the transfer belt 8, with the transfer medium P being in contact with the transfer blade 13 across the transfer belt 8 over a width of 1.0 mm. Note that the center of "b" is at a position offset from a vertical line from a center of the photosensitive drum 1 by 0.25 mm.

Reference character "c" represents the general width of the transfer bias nipping, which is the range of the electric field from the voltage applied to the transfer blade 13, which is approximately 3 mm. Note that a center of "c" is also at a position offset from the vertical line from the center of the photosensitive drum 1 by 0.25 mm. The width of "c" is a value obtained under the conditions of the voltage applied to the transfer blade 13 being +2 kV and the current at this time being +20 $\mu$A.

Figure 3:
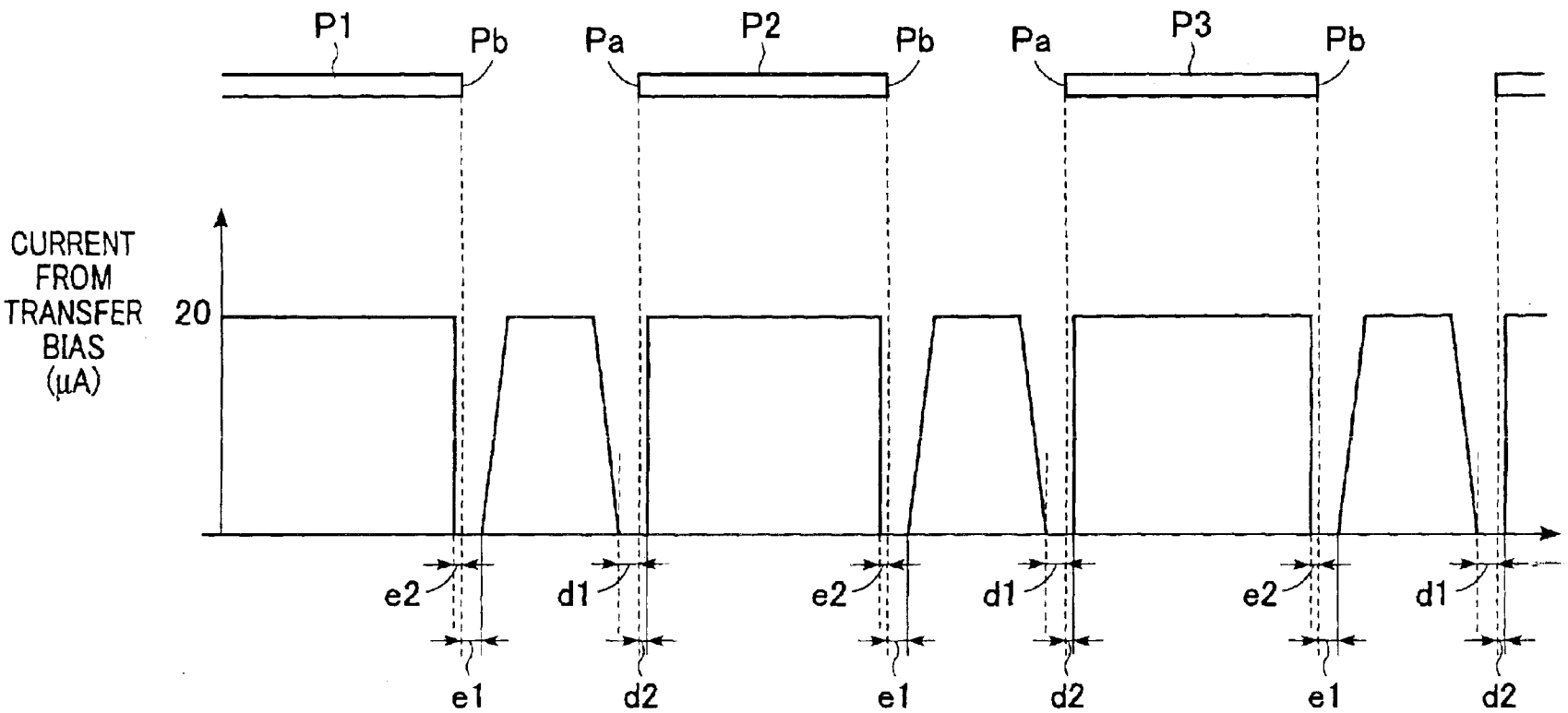
FIG. 3 is a diagram illustrating the position and relation between the transfer bias in the transfer unit and the transfer medium.

Next, a transfer bias applied with the present embodiment will be described with regard to a position relation of sheets the transfer medium P (sometimes referred to individually herein as a "sheet" and collectively as "sheets"), with reference to FIG. 3. The state shown in FIG. 3 is that observed at a center position of nipping between the transfer blade 13 and the transfer medium P. Also, in the figure, P1 (P2) represents a preceding transfer medium, P3 (P3) represents a subsequent transfer medium, Pa represents the leading edge of the transfer medium, and Pb represents the trailing edge thereof, With the present embodiment, the transfer process is carried out under constant current control wherein a current of +20 μA is applied while the transfer mediums P1, P2, and P3 are passing through the nipping portion between the transfer blade 13 and the photosensitive drum 1. Also, current control is performed wherein a current of +20 μA is applied between the preceding transfer medium P1 and the subsequent transfer medium P2, and between the preceding transfer medium P2 and the subsequent transfer medium P3 (this spacing between the transfer mediums will be referred to as "sheet spacing"), as well.

The constant current control values at the time of transfer operations may be made to be variable according to environmental conditions or the like, in order to achieve even more precise transfer control. In this case, the constant current for the sheet spacing may be fixed at a constant value, or may be made to be variable according to conditions, but formation of an electric field which gathers toner on the photosensitive drum and does not gather the external additives which have a polarity which is inverse to a polarity of the toner, is necessary.

Also, with the present embodiment, charging of the photosensitive drum 1 by the primary charger 2 is performed for sheet spacing in the same way as charging when forming images. Further, the developing bias applied to the developing device 4 is the same for both sheet spacing and image formation.

Applying a bias with a polarity for removing only the toner from the photosensitive drum 1 by the transfer belt 8, i.e., a positive polarity in the event that the toner is of a negative polarity, to the transfer blade 13 in the sheet spacing means that the toner moves to the transfer belt 8, but the external additives which has a polarity inverse to a polarity of the toner remains on the photosensitive drum 1, and the remaining external additives are carried to the cleaning device 11.

In the event that the external additives are not removed and only the toner is removed from the photosensitive drum 1, the percentage of external additives near to the cleaner blade rises, thereby improving the effects of suitably polishing the photosensitive member, and the substances generated by discharge of the chargers or components in the toner adhering to the surface of the photosensitive member can be almost completely scraped off.

On the other hand, applying a transfer bias near to the leading and trailing edges of the sheet causes the transfer bias to flow to the photosensitive member at the leading and trailing edge portions of the sheet in an intensive manner, and accordingly only that portion of the photosensitive member is charged by the transfer bias. This charging potential causes toner near to the cleaner to adhere to the surface of the photosensitive member, which appears on the toner image formed on the photosensitive member, one (rotation) cycle of the photosensitive member later, as a streak.

That is to say, while there is need to apply transfer bias during the sheet spacing, transfer bias must not be applied to the transfer blade 13 near the leading and trailing edges of the transfer medium P, in order to avoid streaks on the photosensitive member one cycle later.

Accordingly, with the present embodiment, the current from the transfer bias at the leading edge of the transfer medium P is changed to 0 μA, d1 ahead of the leading edge of the sheet, and following the leading edge of the sheet passing d2, the current for transfer bias is changed to +20 μA based on position detection signals from sensors (not shown) for detecting the position of the transfer medium P, for example, as shown in the drawings. The control for realizing this is performed by the control unit 30 (control means, transfer bias application control means).

Thus, the existence of an electric field due to the transfer bias can be eliminated from the leading edge Pa of the subsequent transfer medium P2 (P3), so that streaks do not appear after one cycle of the photosensitive drum 1. That is to say, the transfer bias is turned off before the leading edge Pa of the subsequent transfer medium P2 (P3) is transported to the transfer unit at such a timing that there is no existence of an electric field due to transfer bias with regard to the leading edge Pa of the subsequent transfer medium P2 (P3), thus eliminating streaks from appearing after one cycle of the photosensitive member 1.

Also, near the trailing edge of the sheet, the current is set to 0 μA for the trailing edge Pb earlier by a time e2, and following the trailing edge of the sheet passing by e1, the current for the transfer bias is changed to +20 μA. That is to say, the transfer bias is turned on following the trailing edge Pb of the preceding transfer medium P1 (P2) passing through the transfer unit at such a timing that there are no effects of the transfer bias at the trailing edge Pb of the preceding transfer medium P1 (P2), thus eliminating streaks from appearing after one cycle of the photosensitive drum 1.

Further, with the present embodiment, in order to eliminate the effects of the electric field from the transfer bias in a sure manner, turning on of the transfer bias following the trailing edge Pb of the preceding transfer medium P1 (P2) passing through the transfer unit, and turning off of the transfer bias before the leading edge Pa of the subsequent transfer medium P2 (P3) is transported to the transfer unit, is performed at a timing such that the trailing edge Pb of the preceding transfer medium P1 (P2) and the leading edge Pa of the subsequent transfer medium P2 (P3) are distanced from the photosensitive drum 1.

Also, in the event that no transfer bias is applied in the sheet space and the photosensitive drum 1 is rotated by one cycle or more in this state, the toner and external additives exist together, resulting in deterioration of the percentage of external additives at the cleaning unit, which is overlaid on the sequence and subsequent cycles and consequently become solidly adhered to the photosensitive drum 1, and is not easy to remove. Accordingly, the time in which the current from transfer bias near the leading and trailing edges of the sheet is set to 0 μA is preferably one cycle of the photosensitive drum or less.

Thus, the time periods d1, d2, e1, and e2 must be determined so that there is no current flowing from the transfer blade 13 to the leading edge of the transfer medium, so that the sheet spacing transfer off time is one photosensitive drum cycle or less, and further so that the image is transferred onto the transfer medium in an image region.

For example, with the present embodiment, the transfer current is set to 0 μA in a margin at the trailing edge of a transfer medium and at a timing wherein the transfer current does not flow to the trailing edge. Next, to turn the transfer bias on in the sheet spacing, the transfer current is turned on to 20 μA within one cycle or less of the image carrying member and at a timing wherein transfer current does not flow to the trailing edge. Subsequently, the transfer current is turned to 0 μA within one cycle or less of the image carrying member and at a timing wherein transfer current does not flow to the leading edge of the transfer medium. Further yet, to transfer to the sheet, the transfer current is turned on to 20 μA in the margin at the leading edge of the transfer medium and at a timing wherein the transfer current does not flow to the leading edge. This is repeated until image formation ends.

As one example of the present embodiment, the following settings were used:

d1=0.10 sec d2=0.01 sec e1=0.25 sec e2=0.01 sec

Also, the leading margin of the transfer medium was set at 2.5 mm, and the trailing margin was set at 2 mm.

FIG. 4 is a Table illustrating the results of forming images setting the values of d1 and so forth as described above. The comparative examples shown in the Table are arrangements wherein the values for the time of d1, d2, e1, and e2 have been changed. Comparative examples 1 and 2 are arrangements wherein d1 has been changed; Comparative examples 3 and 4, d2; Comparative examples 5 and 6, e1; and Comparative examples 7 and 8, e2, respectively.

As can be understood from the Table, suitable values exist for each of d1, d2, e1, and e2, and the values require that there is no current flow to the edge portion at the leading and trailing edges of the transfer medium from the transfer blade 13, that the sheet spacing transfer off time is one photosensitive drum cycle or less, that the transfer bias current is set to 0 $\mu$A within the margin at the leading and trailing margins, and that the image is transferred onto the transfer medium in the image region. Setting d1, d2, e1, and e2, to the values described here enables very excellent image formation to be realized.

Thus, applying the transfer bias in the sheet spacing allows removal of substances adhering to the photosensitive drum while preventing chattering and eversion of the cleaning blade, and setting the electric field from the transfer bias affecting the photosensitive member at the leading and trailing edges of the sheet to zero prevents streaks from appearing one photosensitive drum cycle later, thereby obtaining an excellent image formation apparatus.

Second Embodiment

Figure 5:
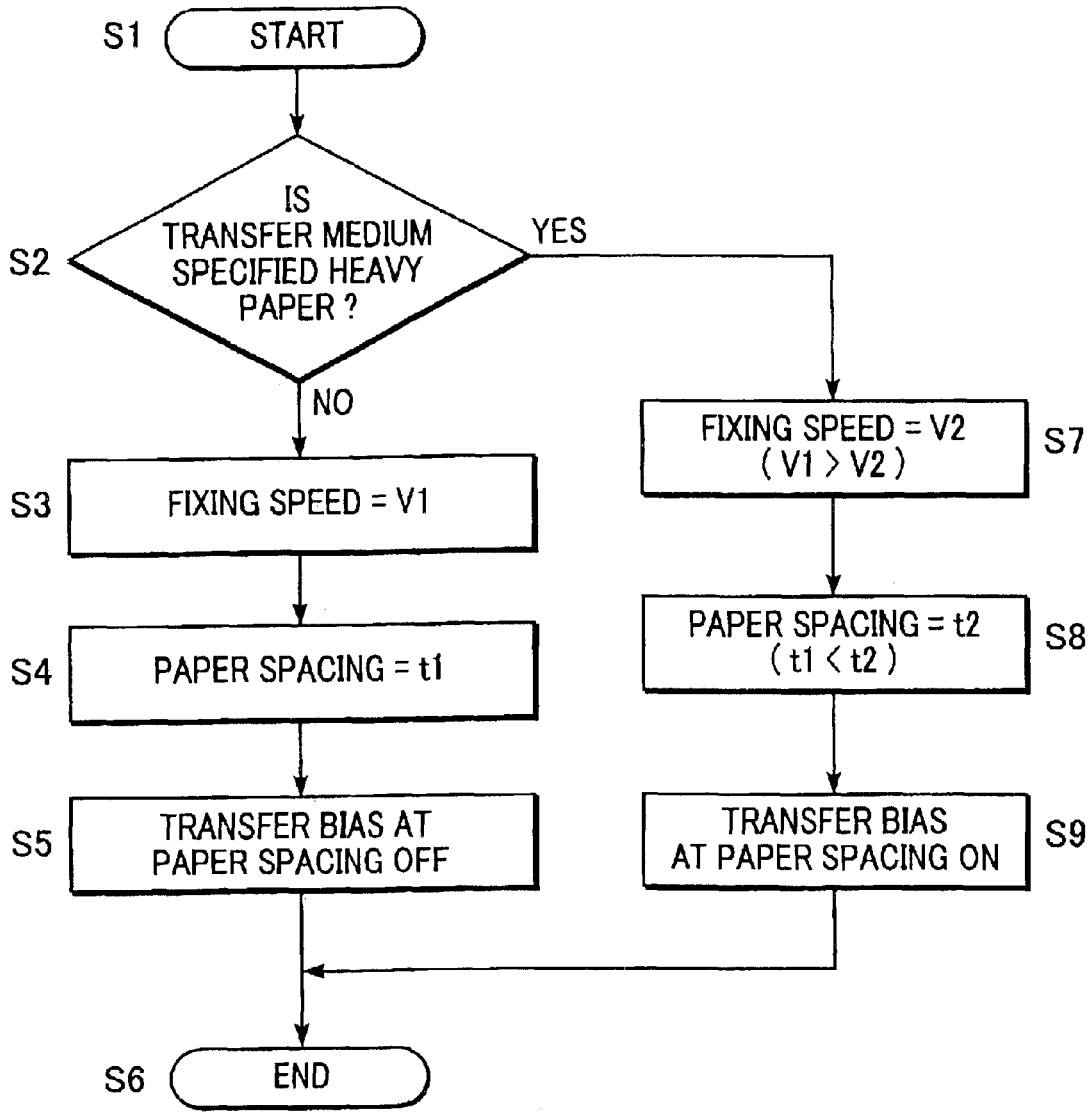
FIG. 5 is a flowchart illustrating a second embodiment of the present invention.

FIG. 5 is a flowchart illustrating a second embodiment of the present invention. With the present embodiment, application of the transfer bias in the sheet spacing described above is not performed for normal sheet spacing, but is performed only in the event of performing image formation wherein the sheet spacing is large.

There is the need to increase throughput of image formation (the number of sheets upon which images are formed per time increment) for normal image formation, and according the sheet spacing is as small as possible. In such cases, high-speed and precise control is required for the transfer bias application control within short sheet spacing, but with little effect, so transfer bias application control is not performed in such cases with the present embodiment. On the other hand, in the event of forming images on the transfer mediums with poor fixing properties, such as heavy paper for example, the fixing speed alone is dropped to improve the fixing capabilities and the sheet spacing is increased so as to be more than with normal operations in order to avoid resultant collisions between sheets of the transfer medium, and accordingly, the transfer bias is applied in sheet spacing in such cases.

The following is a description of an operation of the invention referring to the flowchart shown in FIG. 5.

Upon a start (S1) of the operation, the type of transfer medium is discerned (S2), and in the event that this is a specified heavy paper, the fixing speed is set at a speed V2 which is slower than the speed V1 for normal image fixing (S7), the sheet spacing is set to t2 which is longer than the sheet spacing t1 for normal image formation (S8), transfer bias application is carried out in the sheet spacing as illustrated in the forgoing embodiment and the operation ends (S6).

On the other hand, in the event that the type of transfer medium is discerned (S2) and this is not a specified heavy paper, the fixing speed is set to the speed V1 for normal image fixing (S3), the sheet spacing is set to the sheet spacing t1 for normal image formation (S4), transfer bias application is not performed (S5) and the operation ends (S6).

Control operations such as the above-described changing of fixing speed, transfer bias application operations, sheet spacing (transfer medium spacing) changes, and so forth, are executed by the control means 30.

As for the means for recognizing a type of transfer medium (denoted by reference numeral 40 in FIG. 1), there is a method for the user inputting information of a type of the transfer medium to the apparatus itself, for example. In addition, there is a method wherein information regarding a type of transfer medium contained in a sheet cassette is indicated on the sheet cassette, which is read by the apparatus and automatically judged. Further, there are methods wherein the apparatus comprises sensors for detecting the thickness of the transfer medium, with the apparatus making automatic judgment based on the sensor information.

With the present embodiment, the method used in the preceding embodiment should be used for applying a sheet spacing bias. In the event that the present embodiment is applied to the image forming apparatus described in the preceding embodiment (with a process speed of 200 mm/sec), the normal fixing speed V1 is 200 mm/sec, the fixing speed for heavy paper is 130 mm/sec, the normal sheet spacing t1 is 30 mm (0.15 sec), and the sheet spacing for heavy paper is 500 mm (2.5 sec), for example.

Third Embodiment

Figure 6:
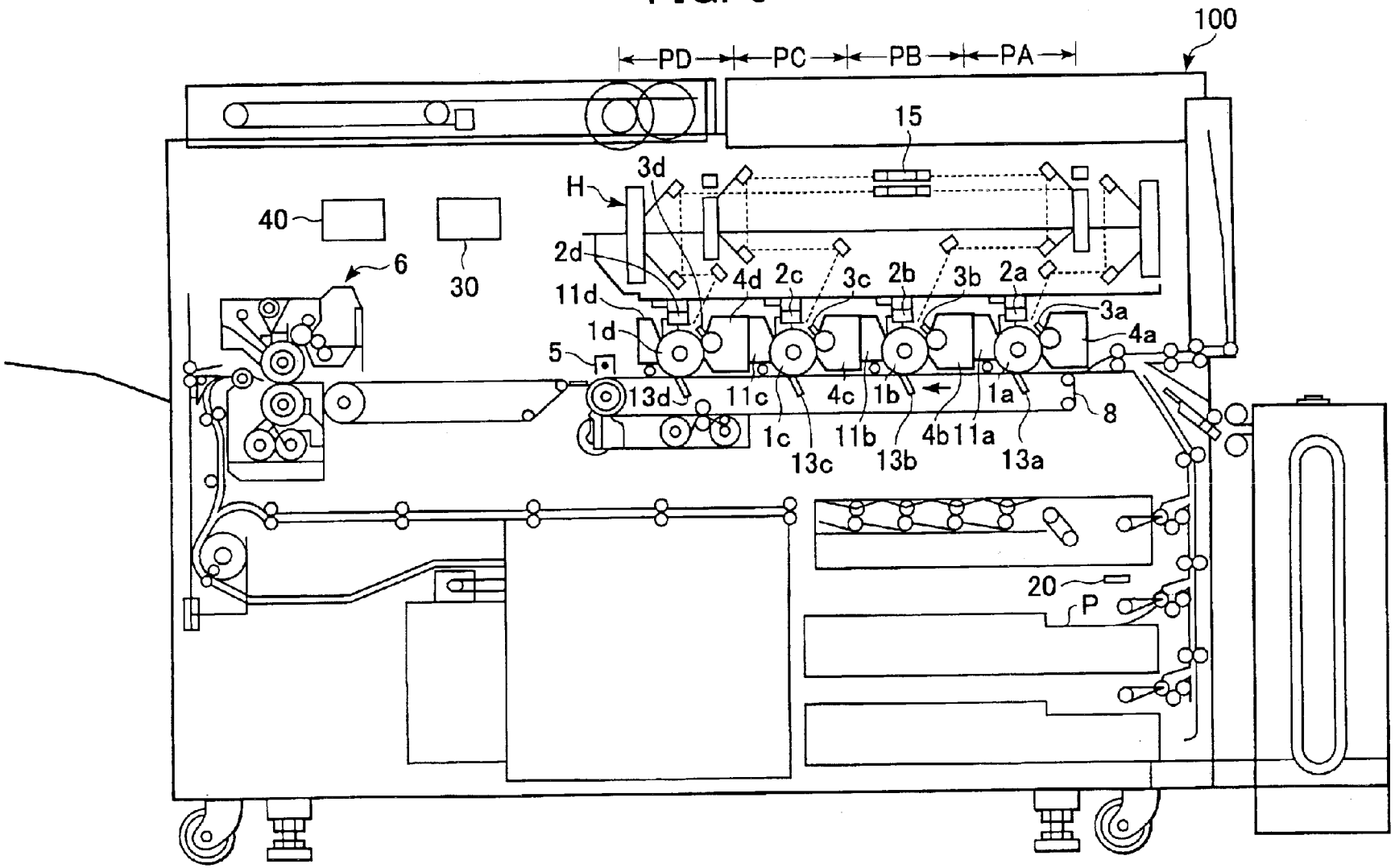
FIG. 6 is a diagram of another example of the image formation apparatus.
Figure 7:
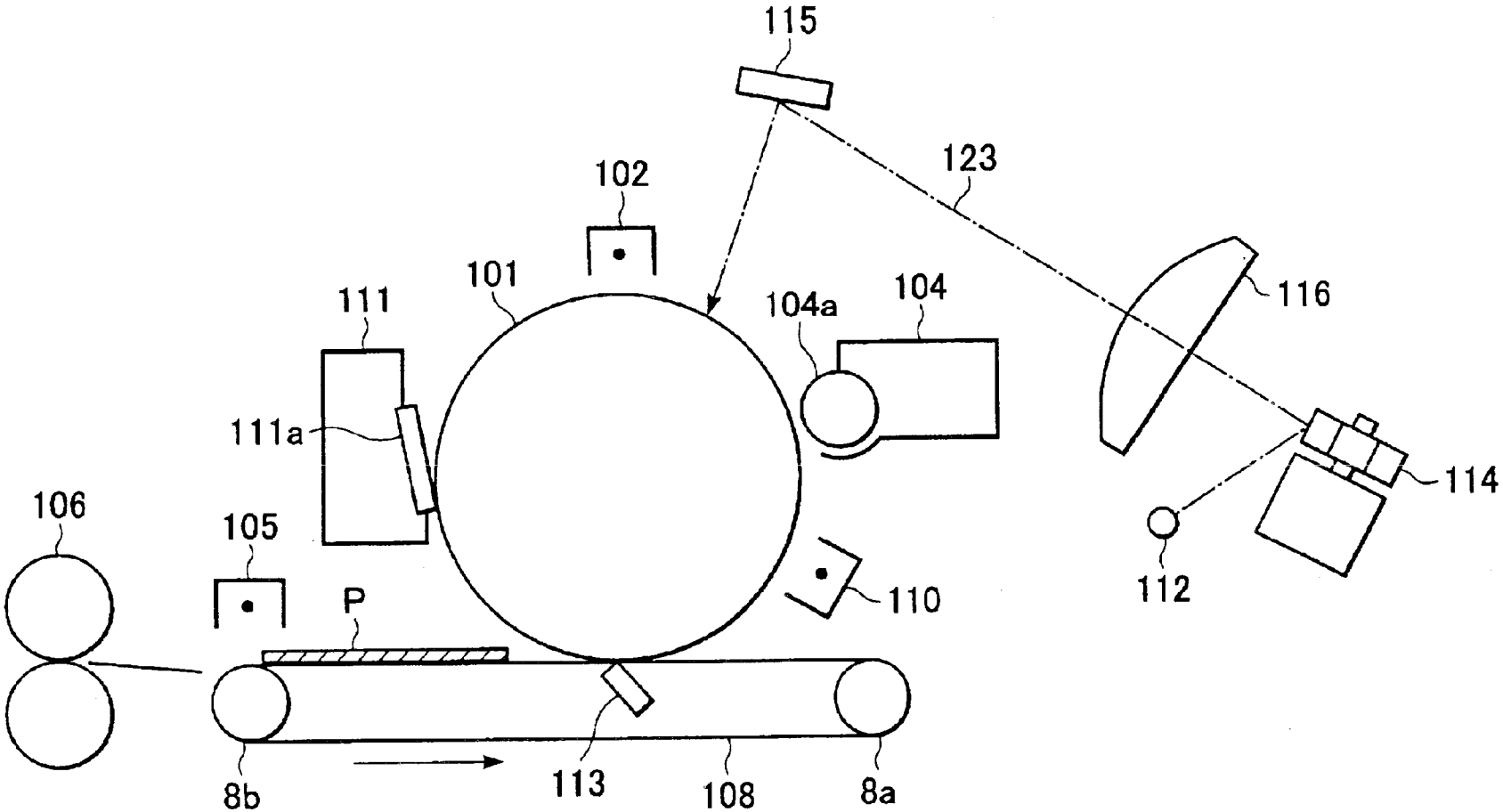
FIG. 7 is a schematic diagram illustrating the internal configuration of a conventional image formation apparatus.

The present invention is not limited to an image formation apparatus having a configuration such as shown in FIG. 1, but may also be applied to a full-color photocopier which is a so-called tandem-type, electrophotography image formation apparatus, which has image formation units for each of the colors yellow, magenta, cyan, and black, as shown in FIG. 6, wherein toner images with different colors that are formed on the image formation units are all transferred onto the transfer media which is being transferred by the transfer belt by adhering thereto, thereby forming a color image.

The full-color photocopier has first through fourth image formation units PA, PB, PC, and PD, for forming images of each of the colors yellow, magenta, cyan, and black, which each have a drum-shaped electrophotography photosensitive members (hereafter referred collectively to as "photosensitive drums") 1*a*, 1*b*, 1*c*, and 1*d*, as image carrying members, as shown in FIG. 6. Disposed around the photosensitive drums are primary chargers 2*a*, 2*b*, 2*c*, and 2*d*, pre-exposing light sources 3*a*, 3*b*, 3*c*, and 3*d*, developing devices 4*a*, 4*b*, 4*c*, and 4*d*, transfer blades 13*a*, 13*b*, 13*c*, and 13*d*, and cleaning devices 11*a*, 11*b*, 11*c*, and 11*d*.

An exposing device, i.e., a laser scanning unit, is disposed above the photosensitive drums 1*a* through 1*d*, from which laser light, modulated corresponding to time-sequence electric digital image signals from image information according to an input original (not shown), is output, and reflected by a polygonal mirror 15 rotating at high speed, so as to expose the surface of the photosensitive drums 1*a* through 1*d* according to each color-separation color, thereby forming color electrostatic latent images corresponding to the image information on the surface of the photosensitive drums 1*a* through 1*d* charged by the primary chargers 2*a* through 2*d*.

The photosensitive drums 1*a* through 1*d* each have a photosensitive layer, e.g., organic photoelectric layer, formed on the circumferential face of an electroconductive photosensitive drum supporting member 1*a* which is 60 mm in diameter and formed of aluminum or the like, rotationally driven at a process speed (circumferential speed) of 200 mm/sec in the direction indicated by the arrow in the figure, i.e., in the clockwise direction, by a driving device (not shown).

The primary chargers 2*a* through 2*d* serving as charging means uniformly charge the surface of the photosensitive drums 1*a* through 1*d* to a predetermined potential of a negative charge, by a charging bias applied a charging bias power source (not shown).

Developing devices 4*a*, 4*b*, 4*c*, and 4*d* have yellow, magenta, cyan, and black color toner, respectively, and cause toner to adhere to the electrostatic latent images formed on the photosensitive drums 1*a* through 1*d* by a developing bias applied from a developing bias power source (not shown), thus forming negative images as toner images, or visualizing the electrostatic latent images.

As for the developing method by the developing devices, the two-component, contact developing method can be employed as a developing agent, which uses a toner wherein magnetic carrier is mixed into toner particles, for example, the toner is transported to the developing region by magnetic force, and is developed onto the photosensitive drums 1*a* through 1*d* in a state of contact.

The transfer blades 13*a*, 13*b*, 13*c*, and 13*d* serving as contact transfer means are formed of an elastic material, and come into contact with the photosensitive drums 1*a* through 1*d* across a transfer belt 8, which is an endless transfer medium carrying member, at the transfer unit. This causes the transfer bias, with a polarity which is inverse to a polarity of the toner which is applied from the transfer bias power source, to sequentially transfer the toner images of each color on the photosensitive drums 1*a* through 1*d* onto the transfer medium P which is a paper sheet or the like being transported by electrostatic adsorption on the moving transfer belt, at the transfer unit between the photosensitive drums 1*a* through 1*d* and the transfer blades 13*a* through 13*d*.

The transfer belt runs over a slave roller and a driving roller, and rotates in the direction indicated by the arrow, synchronously with rotations of the photosensitive drums 1*a* through 1*d*, by a rotational driving force of the driving roller.

Cleaning devices 11*a*, 11*b*, 11*c*, and 11*d* each have a cleaning blade formed of an elastic material and a cleaning member including a supporting member for supporting the cleaning blade, wherein the cleaning blades follow the respective photosensitive drums 1*a* through 1*d* in the longitudinal area and are in contact therewith in a direction counter to a rotation direction of the photosensitive drums. Also, scoop sheets are provided upstream from the cleaning blades in respect to the rotating direction of the photosensitive drums 1*a* through 1*d*, i.e., below the cleaning blades. All of the residual toner on the surface of the photosensitive drums 1*a* through 1*d* which has been scraped off by the cleaning blades is recovered in a cleaning container by the scoop sheets.

Next, image formation operations of a full-color photocopier 100 having such a configuration will be described.

Upon an image formation operations start signal being given, the photosensitive drums 1*a* through 1*d* of the image formation units PA, PB, PC, and PD, which are rotationally driven at a predetermined process speed (200 mm/sec for the present embodiment) have their surface charge removed by the pre-exposure light source, and then are each uniformly charged negatively by the primary chargers 2*a* through 2*d*. The exposing device converts input color-separated image signals into light signals for each color, and scans laser beams which are converted light signals on the respective photosensitive drums 1*a* through 1*d* so as to perform scanning exposures, thus forming electrostatic latent images.

First, yellow toner is made to adhere to the electrostatic latent image formed on the photosensitive drum 1*a*, by a developing sleeve of the developing device to which developing bias with the same polarity as the charging polarity of the photosensitive drum 1*a*, i.e., a negative polarity, is applied, thereby performing inverse developing and visualizing a toner image.

The transfer medium P such as a paper sheet or the like fed at this timing is transported on the transfer belt. The transfer medium P transported on the transfer belt electrostatically adheres to the surface of the transfer belt which is moved by driving of the driving roller with an absorption roller pair which applies absorption bias to the surface thereof, is transported to the transfer unit of the image formation unit PA, and a yellow toner image is transferred onto the transfer medium P by the transfer blade 13*a* to which transfer bias (with a polarity which is inverse to a polarity of the toner. i.e., a positive polarity) has been applied.

Next, the transfer medium P, upon which the yellow toner image has been transferred as described above, remains adhered to the surface of the transfer belt and moves to the image formation unit PB. Here, a magenta toner image formed on the photosensitive drum 1*b* in the same manner as described above is transferred onto the transfer medium P on top of the yellow toner image, by the transfer blade 13*b* to which transfer bias (with a polarity which is inverse to a polarity of the toner, i.e., a positive polarity) has been applied.

Subsequently, the cyan and black toner images formed on the photosensitive drums 1*c* and 1*d* of the image formation units PC and PD are sequentially transferred onto the transfer medium P on top of the yellow and magenta toner images overlaid, by the transfer blades 13*c* and 13*d* to which a transfer bias (with a polarity which is inverse to a polarity of the toner, i.e., a positive polarity) has been applied, thereby forming a full-color toner image on the transfer medium P.

The transfer medium P upon which the full-color toner image has been formed is separated from the surface of the transfer belt by the separating charger 5 and is transported to the fixing device 6 by a transporting guide, wherein the full-color toner image is heated and pressed at the fixing nip portion to thermally fix the image on the surface of the transfer medium P, following which the transfer medium P is discharged from the apparatus, and thus the series of image formation operations ends.

With the above-described image formation apparatus as well, advantages similar to those described above can be obtained by performing transfer bias application control such as described in the first and second embodiments on the four photosensitive drums 1*a*, 1*b*, 1*c*, and 1*d*, taking the positional relation with the transfer medium P into consideration.

The foregoing embodiments have been described with reference to an example wherein a transfer blade is used as transfer means, the present invention is by no means restricted to this arrangement, and may use a transfer roller, brush, or corona charger, for example. However, it should be noted that contact transfer members such as blades or rollers or brushes are preferable in cases of performing control with precise timing.

Further, although the method for performing transfer bias application control in the sheet spacing has been described in the above embodiments as being carried out by constant current control, the method may be carried out by constant voltage control, as well.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image formation apparatus, comprising:

image formation means for forming a toner image on an image carrying member;

transporting means for transporting a transfer medium;

transfer means for electrostatically transferring the toner image onto a transfer medium transported by said transporting means to a transfer unit;

cleaning means for cleaning residual matter including toner from a surface of said image carrying member;

bias applying means for applying a bias of a polarity which is inverse to a normal polarity of the toner, to said transfer means; and control means for controlling operations of said bias applying means;

wherein, in the event of forming an image on multiple transfer mediums in a continuous manner, said control means places said bias applying means in an inoperative state at a first timing before a trailing edge of a preceding transfer medium is transported to said transfer unit places said bias applying means in an operating state ai a second timing following the trailing edge of the preceding transfer medium passing through said transfer unit, places said bias applying means in an inoperative state at a third timing before a leading edge of a subsequent transfer medium is transported to said transfer unit, and places said bias applying means in an operating state at a fourth timing following the leading edge of the subsequent transfer medium passing through said transfer unit.

2. An image formation apparatus according to claim 1, wherein said toner carrying member comprises a rotating member;

and wherein a duration for each of a time from the first timing to the second timing, and a time from the third timing to the fourth timing, is shorter than a duration of time required for said image carrying member to make one rotation.

3. An image formation apparatus according to claim 1, wherein a duration of time from the first timing to the second timing, is longer than a duration of time from the third timing to the fourth timing.

4. An image formation apparatus according to claim 1, wherein the first timing and the fourth timing occur outside a toner image transfer region on the transfer medium.

5. An image formation apparatus according to claim 1, wherein a bias value applied between the second timing to the third timing is approximately the same as a bias value applied when transferring the toner image.

6. An image formation apparatus according to claim 1, wherein said transfer means comprises:

a transfer belt for transporting the transfer medium; and a transfer medium provided on an opposite side of said transfer belt as a transporting face of said transfer belt.

7. An image formation apparatus according to claim 1, wherein particles having polarity, which is inverse to the normal charging polarity of the toner, are externally added to the toner.

8. An image formation apparatus according to claim 7, wherein said image formation means comprises:

charging means for charging said image carrying member by application of a charging bias;

exposing means for forming a latent image by exposing said charged image carrying member; and developing means for developing the latent image with the toner by application of a developing bias;

wherein, in a period from the first timing to the fourth timing, the charging bias is applied to said charging means, and the developing bias is applied to said developing means.

9. An image formation apparatus, comprising:

image formation means for forming a toner image on an image carrying member;

transporting means for transporting a transfer medium;

transfer means for electrostatically transferring the toner image onto a transfer medium transported by said transporting means to a transfer unit;

cleaning means for cleaning residual matter including toner from a surface of said image carrying member:

bias applying means for applying a bias of a polarity which is inverse to a normal polarity of the toner, to said transfer means;

bias application operations control means for controlling operations of said bias applying means;

fixing means for fixing a toner image transferred to the transfer medium; and transfer medium spacing control means capable of changing a transfer medium spacing time from a trailing edge of a preceding transfer medium passing through said transfer unit until a leading edge of a subsequent transfer medium is transported to said transfer unit, in the event of forming images on multiple transfer mediums in a continuous manner, wherein said bias application operations control means enable said bias applying means to be operational in the transfer medium spacing time according to the transfer medium spacing time.

10. An image formation apparatus according to claim 9, further comprising transfer medium recognizing means for recognizing a type of the transfer medium;

wherein said transfer medium spacing control means changes the transfer medium spacing time based on information provided by said transfer medium recognizing means.

11. An image formation apparatus according to claim 10, further comprising fixing speed changing means for changing a fixing speed of said fixing means;

wherein said fixing speed changing means change the fixing speed based on information from said transfer medium recognizing means;

and wherein said transfer medium spacing control means changes the transfer medium spacing time according to the fixing speed.

12. An image formation apparatus according to claim 9, wherein, in the event that said bias application operations control means enable said bias applying means to be operational within the transfer medium spacing time;

said bias application operations control means place said bias applying means in an inoperative state at a first timing before a trailing edge of a preceding transfer medium is transported to said transfer unit, places said bias applying means in an operating state at a second timing following the trailing edge of the preceding transfer medium passing through said transfer unit, places said bias applying means in an inoperative state at a third timing before a leading edge of a subsequent transfer medium is transported to said transfer unit, and places said bias applying means in an operating state at a fourth timing following the leading edge of the subsequent transfer medium passing through said transfer unit.

13. An image formation apparatus according to claim 12, wherein said image carrying member comprises a rotating member:

and wherein a duration for each of a time from the first timing to the second timing, and a time from the third timing to the fourth timing, is shorter than a duration of time required for said image carrying member to make one rotation.

14. An image formation apparatus according to claim 12, wherein the duration of time from the first timing to the second timing, is longer than the duration of time from the third timing to the fourth timing.

15. An image formation apparatus according to claim 12, wherein the first timing and the fourth timing occur outside the toner image transfer region of the transfer medium.

16. An image formation apparatus according to claim 12, wherein a bias value applied between the second timing to the third timing is approximately the same as a bias value applied when transferring the toner image.

17. An image formation apparatus according to claim 12, wherein said transfer means comprises:

a transfer belt for transporting the transfer medium; and a transfer medium provided on an opposite side of said transfer belt as a transporting face of said transfer belt.

18. An image formation apparatus according to claim 12, wherein particles of a polarity, which is inverse to a normal charging polarity of toner, are externally added to the toner.

19. An image formation apparatus according to claim 18, wherein said image formation means comprises:

charging means for charging said image carrying member by application of a charging bias;

exposing means for forming a latent image by exposing said charged image carrying means; and developing means for developing the latent image with the toner by application of a developing bias;

wherein, in a period from the first timing to the fourth timing, the charging bias is applied to said charging means, and the developing bias is applied to said developing means.

* * * * *

UNITED STATES PATENT AND TRADEMARK OFFICE

CERTIFICATE OF CORRECTION

PATENT NO. : 6,832,059 B2
DATED : December 14, 2004
INVENTOR(S) : Motohiro Fujiwara It is certified that error appears in the above-identified patent and that said Letters Patent is hereby corrected as shown below:

Title page,
Item [57], ABSTRACT,
Line 6, "form" should read -- from --.

Column 5,
Line 21, "age" should read -- image --.

Column 7,
Line 33, "has" should read -- have --.

Column 10,
Line 2, "forgoing" should read -- foregoing --.

Column 13,
Line 40, "ai" should read -- at --.

Signed and Sealed this

Twenty-fourth Day of May, 2005

JON W. DUDAS
*Director of the United States Patent and Trademark Office*